United States Patent [19]

Baker

[11] Patent Number: 4,837,539

[45] Date of Patent: Jun. 6, 1989

[54] MAGNETIC SENSING PROXIMITY DETECTOR

[75] Inventor: Gerald S. Baker, Houston, Tex.

[73] Assignee: Cameron Iron Works USA, Inc., Houston, Tex.

[21] Appl. No.: 130,242

[22] Filed: Dec. 8, 1987

[51] Int. Cl.[4] ..... H01H 9/00

[52] U.S. Cl. ..... 335/207; 335/205

[58] Field of Search ..... 335/205–207, 335/153

[56] References Cited

U.S. PATENT DOCUMENTS

| | | | |
|---|---|---|---|
| 3,176,096 | 3/1965 | Marcum . | |
| 3,390,362 | 6/1968 | Hoeppel | 335/153 |
| 3,974,469 | 8/1976 | Nicholls | 335/205 |
| 4,117,431 | 9/1978 | Eicher . | |
| 4,225,837 | 9/1980 | Fowler . | |
| 4,414,518 | 11/1983 | Farr | 335/205 |
| 4,674,338 | 6/1987 | Carpenter . | |

*Primary Examiner*—E. A. Goldberg
*Assistant Examiner*—Lincoln Donovan
*Attorney, Agent, or Firm*—Vinson & Elkins

[57] ABSTRACT

The improved magnetic proximity detector includes a tubular housing, a tubular magnet fixed in position within the housing, a first movable magnet within the housing at one end of the tubular magnet, a second movable magnet with the housing at the other end of the tubular magnet, an annular magnet positioned in surrounding relationship to the housing and being adjustable axially with respect to the housing, a switch having a blade, a first contact and a second contact, a connection extending between the first and second movable magnets and to the switch blade to move the switch blade responsive to movement of the magnets, the poles of the first movable magnet arranged so that the magnet is attracted to the tubular magnet, the poles of the second movable magnet arranged so that the magnet is repelled by the tubular magnet, the end of the housing containing the first movable magnet moving the two magnets responsive to ferrous metal in close spaced relationship to such end to change the position of the blade switch and the movement of the annular magnet changing the focus of the flux from the end of the housing containing the first magnet to adjust the distance at which the presence of ferrous metal causes the change of position of the switch blade.

8 Claims, 3 Drawing Sheets

MAGNETIC SENSING PROXIMITY DETECTOR

BACKGROUND

The present invention relates to an improved magnetic sensing proximity detector. Magnetic sensing proximity detectors have been used previously to detect the close presence of a ferrous metal mass. In one form these detectors have includes a central hollow magnet with end magnets supported on a rod connecting them which extends through the opening in the central magnet. A switch is connected at one end of the two connected magnets to be operated by the movement of such two magnets relative to the central magnet and the housing in which it is secured. The approach of a ferrous metal close to the end of the magnet away from the switch end causes the magnets and their connecting rod to move toward the ferrous metal to thus change the position of the switch. An example of this type of magnetic sensing proximity switch is disclosed in U.S. Pat. No. 4,117,431.

Another type of magnetic sensing proximity detector is shown in U.S. Pat. No. 4,674,338 in which a central magnet is positioned within two annular magnets so that the movement of the central magnet which is normally biased in one direction by the positioning of the poles of the three magnets, moves in the opposite direction when a magnetic material approaches sufficiently close to change the forces on the central magnet to overcome the force biasing it toward the one direction.

A further type of magnetic sensing proximity detector is shown in U.S. Pat. Nos. 3,176,096 and 4,225,837 wherein side-by-side magnets are used so that the position of the switch arm is normally in one position and pivots to the opposite position on the approach of a ferrous metal within the range of sensitivity of the detector. The latter patent is stated to be an improvement on the former patent.

One disadvantage which has been experienced with the prior magnetic sensing proximity detectors is their very limited range in which they can sense the approach a ferrous metal material and the fact that such prior devices are not adjustable to preselect the exact point at which the approach of ferrous metal causes the detector to change its position.

SUMMARY

The improved magnetic proximity detector includes a tubular housing, a tubular magnet fixed in position within the housing, a first movable magnet within said housing at one end of said tubular magnet, a second movable magnet within the housing at the other end of the tubular magnet, an annular magnet positioned in surrounding relationship to the housing, means for adjusting the position of the annular magnet to control the sensitivity of the assembly, means connecting the first magnet and the second magnet, a switch including a blade, a first contact and a second contact, means connecting said first and second magnet to said blade so that movement of said first and second magnets moves said blade between contact with the first and second contacts, the first magnet having its poles arranged so that it is attracted to said tubular magnet, said second magnet having its poles arranged so that it is repelled by said tubular magnet, the nearness of a ferrous metal to the end of said housing containing said first magnet moving the two magnets and the blade to change the position of the switch, adjusting the axial position of said annular magnet changing the flux from the end of the housing containing the first magnet to adjust the distance at which a ferrous metal causes the change of position of the switch blade.

An object of the present invention is to provide an improved magnetic proximity detector which has increased range of sensitivity to ferrous metal.

A further object is to provide an improved magnetic proximity detector which has an adjustable range of sensitivity to ferrous metals.

BRIEF DESCRIPTION OF THE DRAWINGS

These and other objects and advantages of the present invention are hereinafter set forth with respect to the drawings wherein.

DESCRIPTION OF THE PREFERRED EMBODIMENTS

Figure 1:
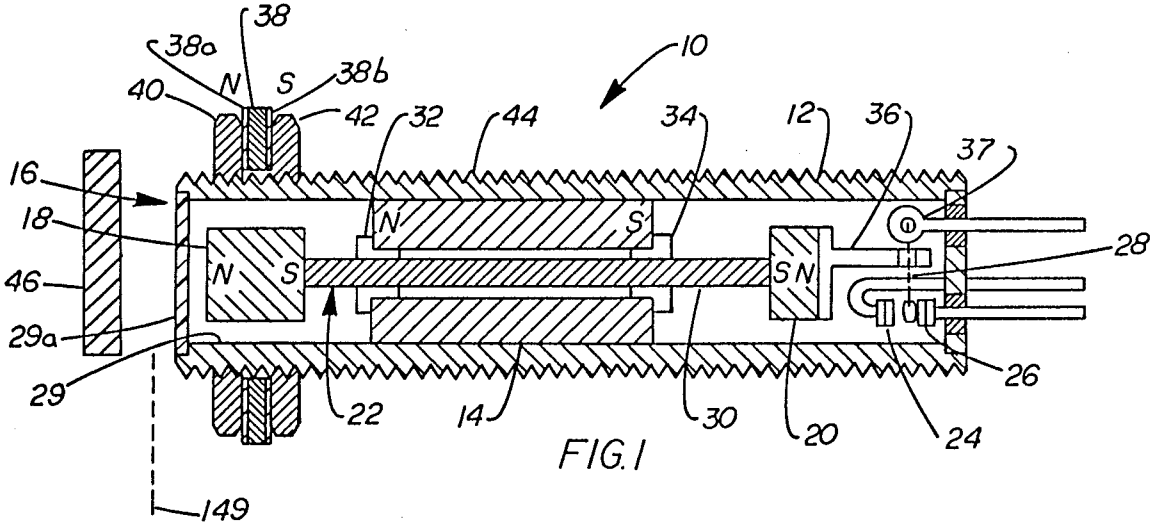
FIG. 1 is a longitudinal sectional view of the improved magnetic proximity detector illustrating the components in one position which does not indicate the presence of ferrous metal.
Figure 2:
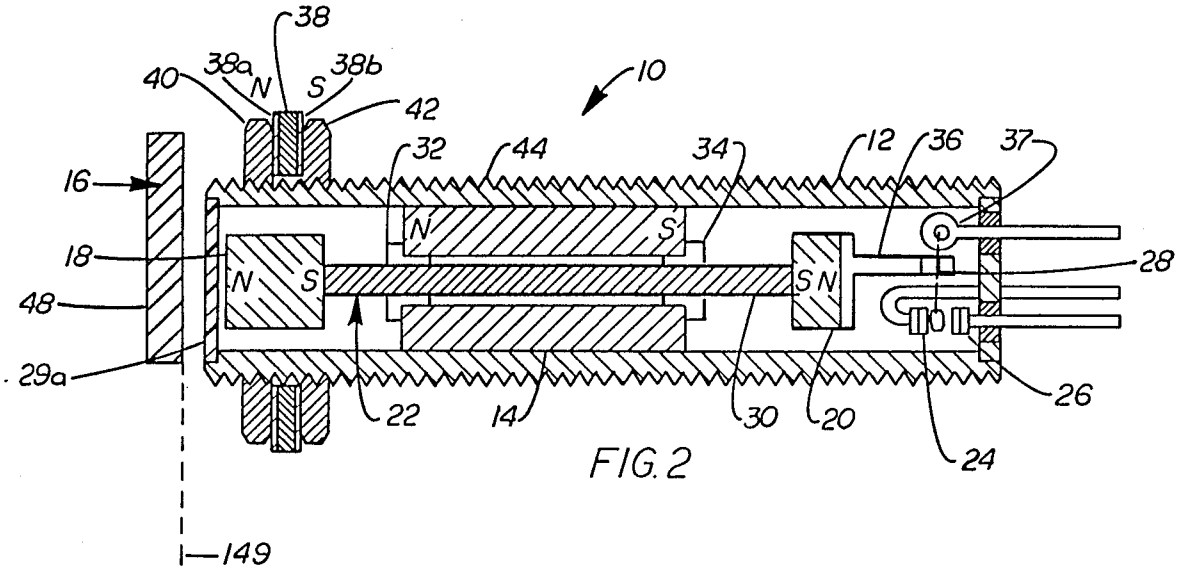
FIG. 2 is a similar sectional view of the detector but showing the components in their opposite position as a result of the detections of a ferrous metal.

The improved structure of the present invention is shown in FIGS. 1 and 2. Detector 10 includes housing 12, tubular magnet 14 secured within housing 12, assembly 16 of movable magnets, and switch contacts 24 and 26 and blade 28. Movable magnet 18 is positioned in end 29 of housing 12 and has its poles arranged with respect to the poles of tubular magnet 14, as shown, so that it is attracted by tubular magnet 14. Movable magnet 20 is positioned within housing 12 on the opposite side of tubular magnet 14 from magnet 18 and has its poles arranged with respect to the poles of tubular magnet 14, as shown, so that it is repelled by tubular magnet 14. A suitable non-magnetic closure 29a is positioned across end 29 of housing 12.

Connecting means 22 includes rod 30 extending through the central axial opening of tubular magnet 14 with support by low friction plastic bearings 32 and 34 which are positioned in the ends of the axial opening through tubular magnet 14 as shown. One end of rod 30 is connected to movable magnet 18 and the other end is connected to movable magnet 20. Extension 36 connects to movable magnet 20 and is secured to blade 28 which is pivotally mounted to contact 37 so that movement of magnet assembly 16 moves blade 28 between positions engaging contacts 24 and 26. In the position shown in FIG. 1 blade 28 connects contact 37 with contact 26.

Annular magnet 38 is positioned around the exterior of housing 12 generally at a position surrounding movable magnet 18. Nuts 40 and 42 are threaded onto threads 44 on the exterior of housing 12 on either side of annular magnet 38 to secure it in a preselected position with respect to movable magnet 18. Nuts 40 and 42, or other suitable adjustable positioning means, are used to adjust the position of annular magnet 38 which adjusts the range of sensitivity of the structure as hereinafter explained.

As shown in FIG. 1 movable magnet assembly is in its right position with blade 28 in engagement with contact 26 since ferrous mass 46 is spaced outside the sensitivity range of detector 10.

Mass 48, shown in FIG. 2, is positioned closer to detector 10 so that is within the sensitivity range, considering the position of annular magnet 38 and assembly 16 has been moved to its left causing blade 28 to move into engagement with contact 24 to complete the circuit between contact 37 and contact 24. It should be noted that annular magnet 38 is shown including pole pieces **38*a* and 38*b*** but may be used without such pole pieces.

Figure 3:
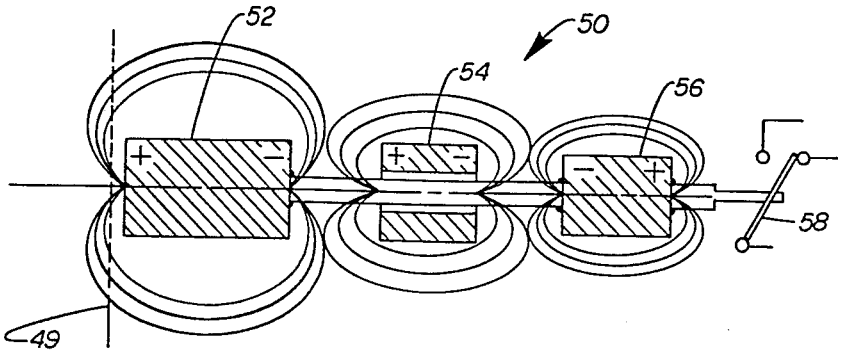
FIG. 3 is a schematic view of the three magnets used with proximity detectors of the prior art and illustrates the relative position of the poles of the magnets and their flux fields.

Dashed line 49 in FIG. 3 illustrates the outer limit of the sensitivity range for detector 10 when annular magnet is not used with detector 10. Detector 50 shown in FIG. 3 is illustrative of the prior art detectors. Detector 50 includes movable magnet 52, fixed tubular magnet 54 and movable magnet 56 controlling the position of blade 58. Detector 50 does not include an external annular magnet for focusing the flux field as hereinafter described. With detector 50 as shown in FIG. 3, the sensitivity range is limited to a maximum of 0.10 inch.

Figure 4:
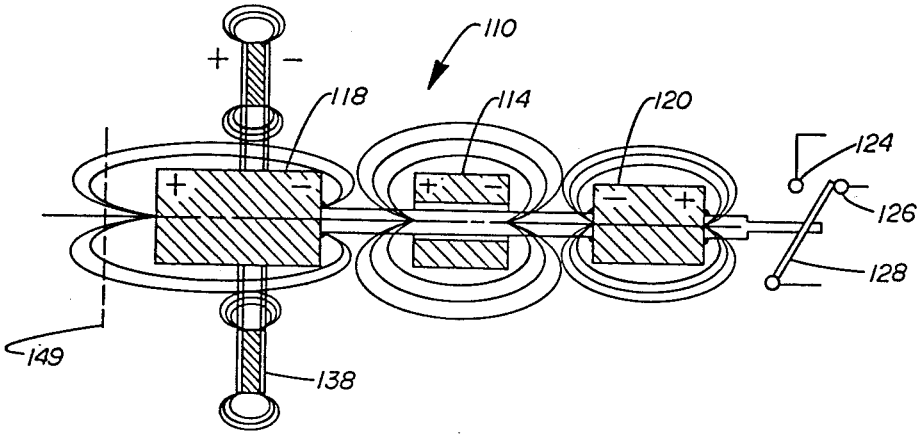
FIG. 4 is a schematic view of the three magnets used in the detector of the present invention and illustrates the relative position of the poles of the magnets, their flux fields and the focusing effect on the flux field at the end of the detector resulting from the annular focusing magnet.

FIG. 4 is a schematic illustration of proximity detector 110 which is the same structure as detector 10 previously described and the components shown are given the same number for identification with the prefix numeral "1". A comparison of the flux field of movable magnet 118 with the flux field of movable magnet 52 illustrates the focusing effect of annular magnet 138 on the flux field to flatten the field and cause it to extend a greater distance beyond the end of magnet 118 than it would extend without annular magnet 138. Dashed line 149 is drawn in position with respect to the end of the housing to illustrate the outer limit of the sensitivity range of detector 10. In comparison the the maximum range of sensitivity of detector 50 being 0.10 inch, the maximum range of sensitivity for detector 110 having all of the same components as detector 50 except for the addition of annular focusing magnet 138 is approximately 0.50 inch. Additionally, the adjusting of the position of annular focusing magnet 138 provides an adjustment of the focusing of the flux field of movable magnet 118 to preselect the exact distance at which a ferrous metal will cause a change in the position of blade 128.

It should be noted the present invention has application to other types of magnetic proximity sensing devices, particularly to a device which includes at least three magnets with at least one magnet movable with respect two fixed magnets in a housing as discloses in U.S. Pat. No. 4,674,338.

What is claimed is:

1. A magnetic proximity detector for ferrous metals comprising a housing, an assembly of magnets, at least one of which is movable, positioned within said housing, a switch, means connecting the movable magnet to the switch to change its position when the magnet moves, said movable magnet being biased to one position by the other magnets of said assembly and moving to its other position responsive to the presence of a ferrous metal within its effective sensitivity range, and means for focusing the flux of said magnets by changing the shape of their magnetic fields to change the effective sensitivity range which causes movement of said movable magnet responsive to the presence of a ferrous metal.

2. A magnetic proximity detector according to claim 1 wherein, one of said magnets of said assembly is fixed within said housing and two of said magnets are movable with respect to said fixed magnet, and means for connecting the two movable magnets.

3. A magnetic proximity detector according to claim 2 wherein, said fixed magnet is tubular with a central opening therethrough, and said connecting means extends through the central opening with a movable magnet positioned within the housing on each end of said fixed magnet.

4. A magnetic proximity detector according to claim 1 wherein said focusing means includes an annular magnet surrounding said housing.

5. A magnetic proximity detector according to claim 4 including means coacting with said annular magnet to adjust its position axially with respect to said housing.

6. A magnetic proximity detector according to claim 5 wherein, said housing includes threads along its exterior, and said adjusting means includes at least one member threaded to the exterior of said housing and held against said annular magnet.

7. A magnetic proximity detector according to claim 6 wherein said adjusting means includes a first nut threaded onto said external housing threads, and a second nut threaded onto said external housing threads, said annular magnet being positioned between said first and second nuts.

8. A magnetic proximity detector according to claim 2 wherein one of said movable magnets is positioned within said housing at one end of said fixed magnet and has its poles arranged with respect to the poles of the fixed magnet so that it is attracted to the fixed magnet, the other of said movable magnets is positioned within said housing at the other end of said fixed magnet and has its poles arranged with respect to the poles of the fixed magnet so that it is repelled by the fixed magnet, the position of said movable magnets being biased in one direction when not detecting the presence of a ferrous metal and the movable magnets moving from said biased position toward a ferrous metal which comes within the effective range of sensitivity of the detector to the ferrous metal.

* * * * *